US010194740B2

(12) United States Patent
Velasquez

(10) Patent No.: US 10,194,740 B2
(45) Date of Patent: Feb. 5, 2019

(54) FLUID DISPENSING BRUSH ASSEMBLY

(71) Applicant: Zap Velasquez, Selma, TX (US)

(72) Inventor: Zap Velasquez, Selma, TX (US)

( * ) Notice: Subject to any disclaimer, the term of this patent is extended or adjusted under 35 U.S.C. 154(b) by 7 days.

(21) Appl. No.: 15/467,544

(22) Filed: Mar. 23, 2017

(65) Prior Publication Data

US 2018/0271267 A1 Sep. 27, 2018

(51) Int. Cl.

| | |
|---|---|
| ***A45D 24/22*** | (2006.01) |
| ***A46B 11/00*** | (2006.01) |
| ***A46B 5/00*** | (2006.01) |
| ***A46B 9/02*** | (2006.01) |

(52) U.S. Cl.

CPC ..... *A46B 11/0006* (2013.01); *A46B 5/0095* (2013.01); *A46B 9/023* (2013.01); *A45D 24/22* (2013.01); *A46B 11/002* (2013.01); *A46B 2200/104* (2013.01)

(58) Field of Classification Search

CPC ... A46B 11/002; A46B 11/0058; A45D 11/22; A45D 11/24; A45D 11/26; A45D 11/28

USPC ..... 604/1–3

See application file for complete search history.

(56) References Cited

U.S. PATENT DOCUMENTS

| | | | | |
|---|---|---|---|---|
| 3,964,501 | A | 6/1976 | Matchett | |
| 5,909,737 | A | 6/1999 | Ricco | |
| 5,927,290 | A | 7/1999 | Thiruppathi | |
| D457,729 | S | 5/2002 | Humphrey | |
| 6,672,313 | B2 | 1/2004 | Battaglia et al. | |
| 6,974,092 | B1 | 12/2005 | Leventhal | |
| 2007/0193597 | A1* | 8/2007 | Hurwitz | A01K 13/002 132/114 |
| 2012/0279513 | A1 | 11/2012 | Blauser et al. | |
| 2014/0158720 | A1* | 6/2014 | Lansky | B05B 11/0059 222/464.4 |

FOREIGN PATENT DOCUMENTS

| | | |
|---|---|---|
| WO | WO2004016130 | 2/2004 |

* cited by examiner

*Primary Examiner* — David Walczak
*Assistant Examiner* — Joshua Wiljanen

(57) ABSTRACT

A fluid dispensing brush assembly enhancing brushing hair includes a brush that may be manipulated thereby facilitating the brush to brush hair. A handle is removably coupled to the brush and the handle may be gripped. The handle is substantially hollow and the handle may contain a fluid. The handle is in fluid communication with the brush. A pump is coupled to the brush and the pump is selectively manipulated. The pump is in fluid communication with the handle to selectively urge the fluid outwardly from the brush thereby facilitating the fluid to enhance brushing the hair.

6 Claims, 5 Drawing Sheets

FLUID DISPENSING BRUSH ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION (1) Field of the Invention (2) Description of Related Art Including Information Disclosed Under 37 CFR 1.97 and 1.98.

The disclosure and prior art relates to brush devices and more particularly pertains to a new brush device for enhancing brushing hair.

BRIEF SUMMARY OF THE INVENTION

An embodiment of the disclosure meets the needs presented above by generally comprising a brush that may be manipulated thereby facilitating the brush to brush hair. A handle is removably coupled to the brush and the handle may be gripped. The handle is substantially hollow and the handle may contain a fluid. The handle is in fluid communication with the brush. A pump is coupled to the brush and the pump is selectively manipulated. The pump is in fluid communication with the handle to selectively urge the fluid outwardly from the brush thereby facilitating the fluid to enhance brushing the hair.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
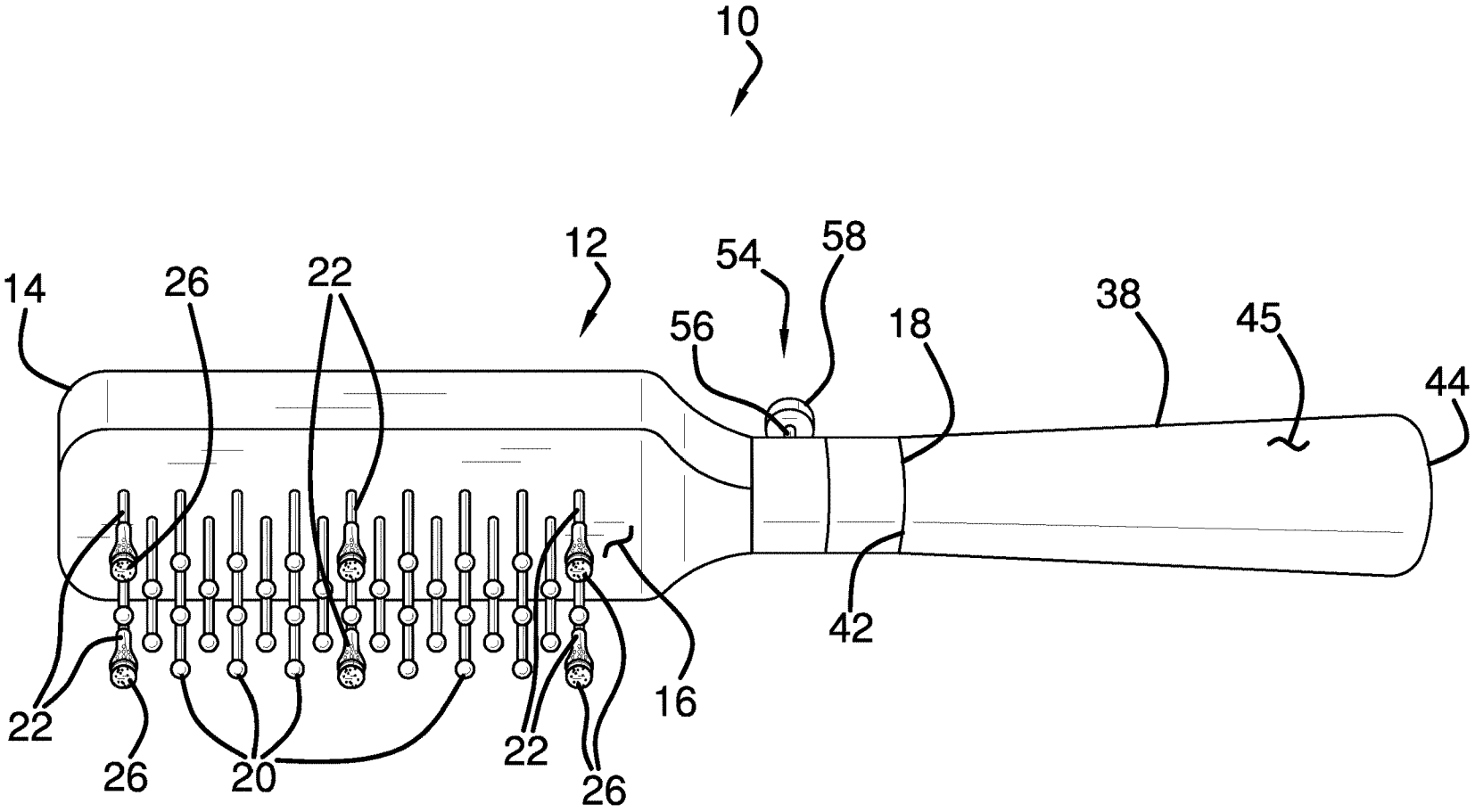
FIG. 1 is a perspective view of a fluid dispensing brush assembly according to an embodiment of the disclosure.
Figure 2:
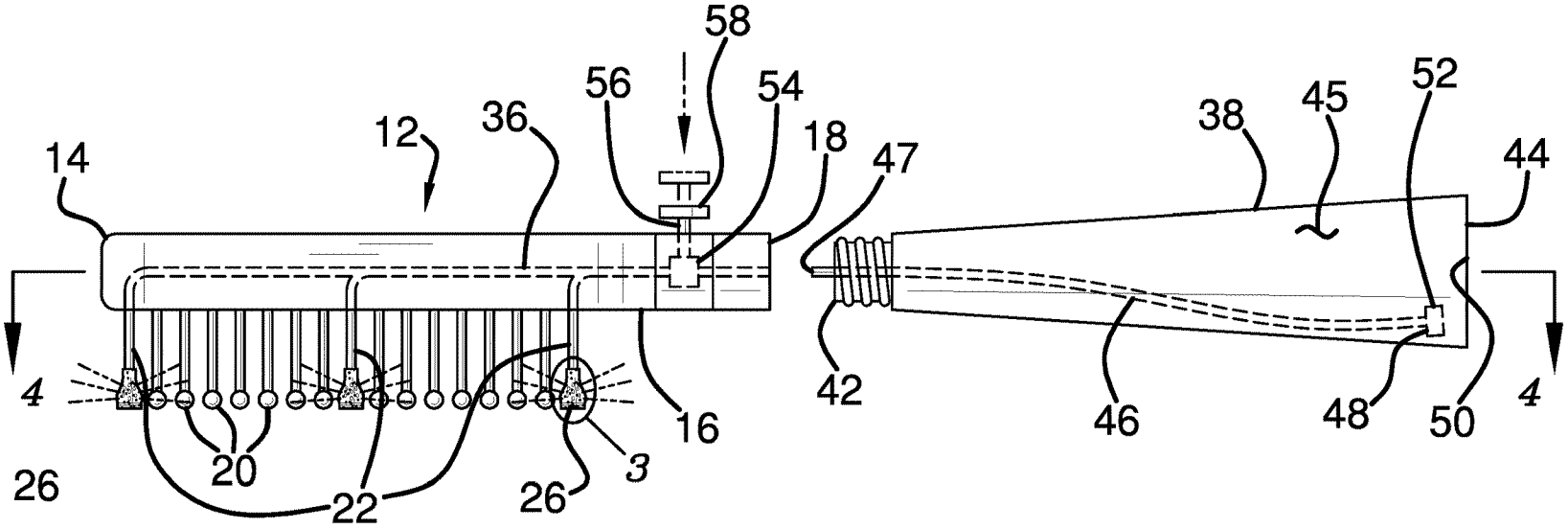
FIG. 2 is a left side phantom view of an embodiment of the disclosure.
Figure 3:
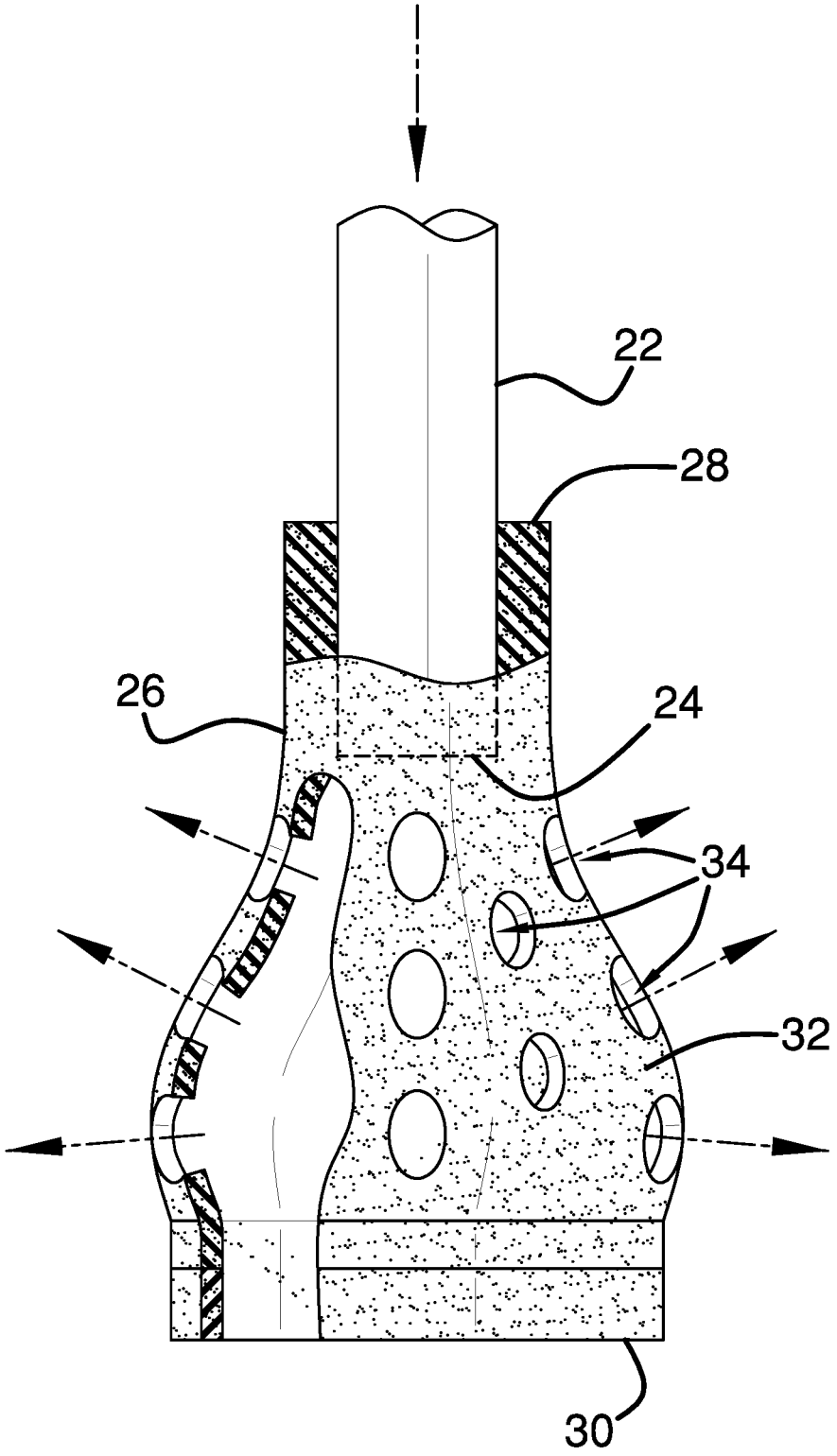
FIG. 3 is a perspective cut-away view taken from circle 3 of FIG. 2 of an embodiment of the disclosure.
Figure 4:
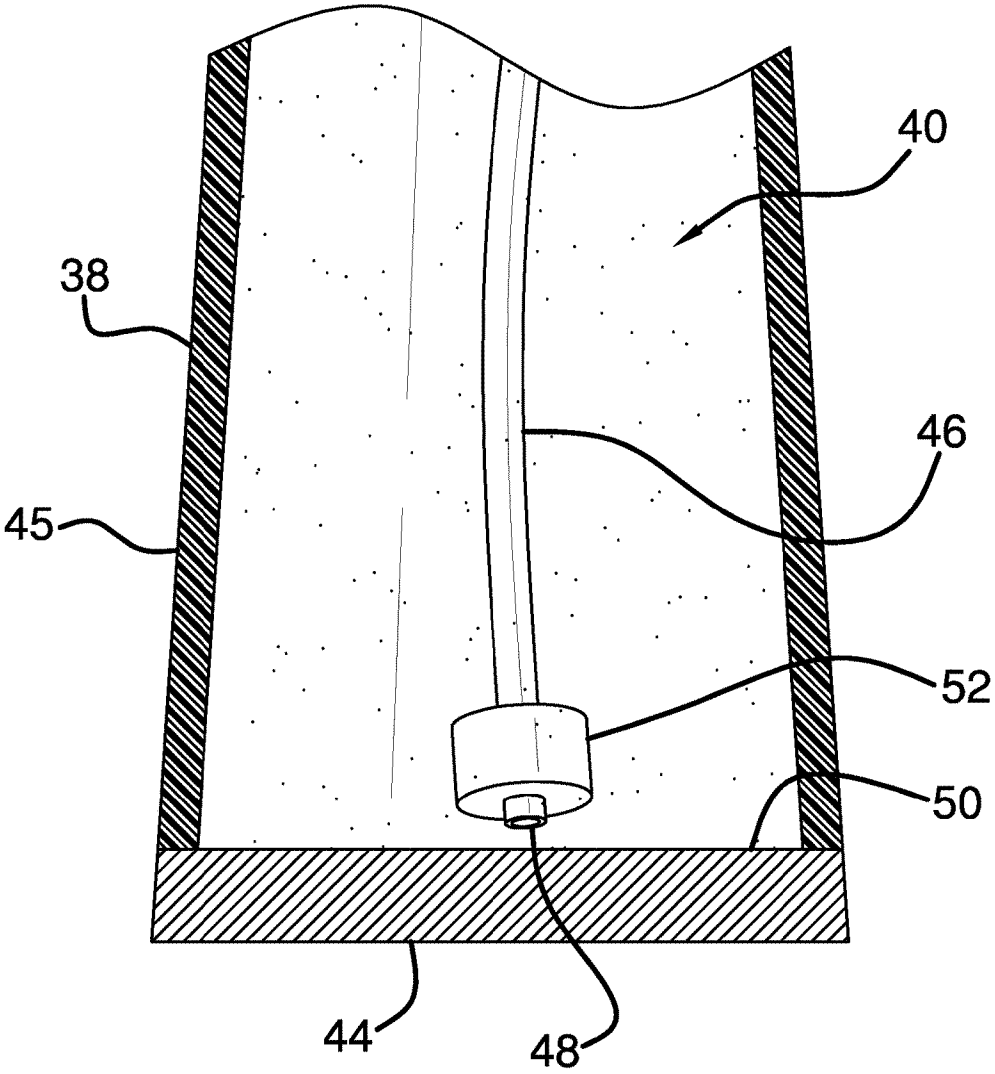
FIG. 4 is a cross sectional view taken along line 4-4 of FIG. 2 of an embodiment of the disclosure.
Figure 5:
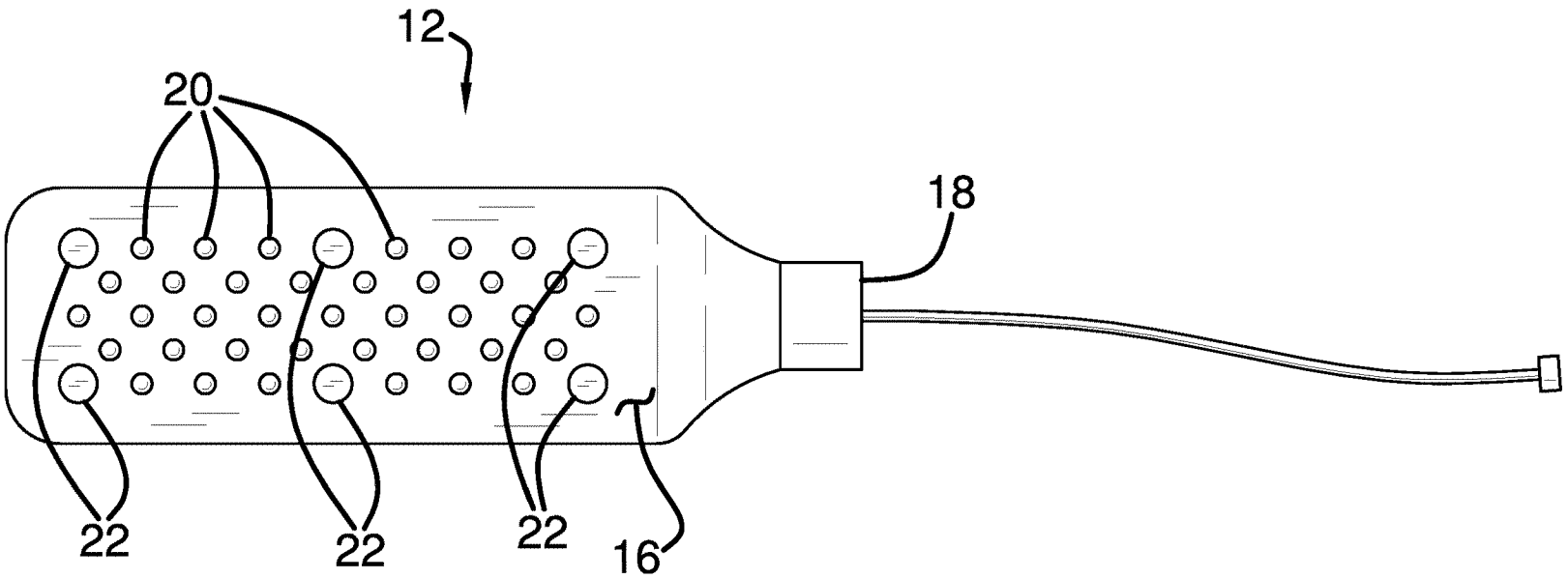
FIG. 5 is a bottom view of brush of an embodiment of the disclosure.

With reference now to the drawings, and in particular to FIGS. 1 through 5 thereof, a new brush device embodying the principles and concepts of an embodiment of the disclosure and generally designated by the reference numeral 10 will be described.

As best illustrated in FIGS. 1 through 5, the fluid dispensing brush assembly 10 generally comprises a brush 12 that may be manipulated thereby facilitating the brush 12 to brush hair. The brush 12 comprises a panel 14 that has a first surface 16 and a first end 18. A plurality of first bristles 20 is provided and each of the first bristles 20 is coupled to and extends away from the first surface 16. Each of the first bristles 20 brushes the hair and the first bristles 20 are spaced apart from each other and are distributed on the first surface 16.

A plurality of second bristles 22 is provided and each of the second bristles 22 is coupled to and extends away from the first surface 16 of the panel 14. Each of the second bristles 22 has a distal end 24 with respect to the first surface 16. Moreover, each of the second bristles 22 is hollow and the distal end 24 corresponding to each of the second bristles 22 is open.

A plurality of boots 26 is provided and each of the boots 26 has a primary end 28, a secondary end 30 and an outer wall 32 extending therebetween. The primary end 28 is open and the outer wall 32 has a plurality of openings 34 extending into an interior of the corresponding boot 26. The primary end 28 insertably receives the distal end 24 of an associated one of the second bristles 22. The outer wall 32 corresponding to each of the second bristles 22 may flare outwardly between the primary end 28 and the secondary end 30 of the corresponding second bristle 22. Each of the boots 26 may be comprised of a resiliently compressible material such as rubber or the like. A conduit 36 is provided and the conduit 36 extends between the first end 18 of the panel 14 and each of the second bristles 22.

A handle 38 is removably coupled to the brush 12 and the handle 38 may be gripped. The handle 38 is substantially hollow and the handle 38 may contain a fluid 40. The fluid 40 may be water, a hair detangler or any other fluid 40 commonly used for hair care. The handle 38 is in fluid communication with the brush 12 and the handle 38 has a leading end 42, a following end 44 and an outer surface 45 extending therebetween. The outer surface 45 is threaded adjacent to the leading end 42 and the outer surface 45 threadably engages the first end 18 of the panel 14. In this way the handle 38 is removably coupled to the brush 12. The following end 44 is weighted such that the brush is retained in an upright position when the following end 44 is placed on a support surface.

A tube 46 is provided that has a first end 47 and a second end 48. The tube 46 is positioned within the handle 38 having the first end 47 extending outwardly from the first end 18 of the handle 38. The first end 47 of the tube 46 is fluidly coupled to the conduit 36 when the handle 38 is coupled to the brush 12 such that each of the second bristles 22 is in fluid 40 communication with the handle 38. The second end 48 of the tube 46 is aligned with a bottom 50 of the handle 38. A weight 52 is positioned around the tube 46. The weight 52 is aligned with the second end 48 of the tube 46 such that the weight 52 retains the tube 46 at the bottom 50 of the handle 38.

A pump 54 is provided and the pump 54 is coupled to the brush 12 such the pump 54 is selectively manipulated. The pump 54 is in fluid communication with the handle 38 to selectively urge the fluid 40 outwardly from the brush 12. In this way the fluid 40 enhances brushing the hair with respect to loosening tangles and lubricating the hair while the hair is being brushed.

The pump 54 is fluidly coupled to the conduit 36 in the panel 14. The pump 54 includes a plunger 56 that extends outwardly from the panel 14. The plunger 56 has a head 58 and the head 58 is selectively urged downwardly to actuate the pump 54. The pump 54 may be a manually operated fluid pump or the like.

In use, the handle 38 is removed from the brush 12 and the handle 38 is filled with the fluid 40. The handle 38 is attached to the brush 12 and the brush 12 is manipulated in the convention of brushing hair. The pump 54 is selectively manipulated to urge the fluid 40 outwardly through the boot 26 corresponding to each of the second bristles 22. In this way the fluid 40 is distributed onto the hair thereby enhancing brushing the hair. The handle 38 is removed from the brush 12 and the handle 38 is refilled with the fluid 40 when the handle 38 is empty.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A fluid dispensing brush assembly being configured to selectively release a fluid while brushing hair, said assembly comprising:

a brush being configured to be manipulated thereby facilitating said brush to brush hair, said brush comprising a panel having a first surface and a first end;

a plurality of first bristles, each of said first bristles being coupled to and extending away from said first surface wherein each of said first bristles is configured to brush the hair, said first bristles being spaced apart from each other and being distributed on said first surface;

a plurality of second bristles, each of said second bristles being coupled to and extending away from said first surface, each of said second bristles having a distal end with respect to said first surface, each of said second bristles being hollow, said distal end corresponding to each of said second bristles being open;

a plurality of boots, each of said boots having a primary end, a secondary end and an outer wall extending therebetween, said primary end being open, said outer wall having a plurality of openings, said primary end insertably receiving said distal end of an associated one of said second bristles, said outer wall having an undulated medial section such that said outer wall is flared to extend outwardly away from said distal end of said second bristle, then back inwardly to a straight end section of said outer wall adjacent and perpendicular to said secondary end of said boot, said openings being distributed along said undulated medial section wherein said openings have varied angling relative to said second bristle;

a handle being removably coupled to said brush wherein said handle is configured to be gripped, said handle being substantially hollow wherein said handle is configured to contain a fluid, said handle being in fluid communication with said brush; and a pump being coupled to said brush wherein said pump is configured to be manipulated, said pump being in fluid communication with said handle wherein said pump is configured to selectively urge the fluid outwardly from said brush thereby facilitating the fluid to enhance brushing the hair.

2. The assembly according to claim 1, further comprising a conduit extending between said first end of said panel and each of said second bristles.

3. The assembly according to claim 1, wherein said handle has a leading end and an outer surface, said outer surface being threaded adjacent to said leading end, said outer surface threadably engaging said first end of said panel.

4. The assembly according to claim 3, further comprising:

a conduit being positioned within said brush; and a tube having a first end and a second end, said tube being positioned within said handle having said first end of said tube extending outwardly from said first end of said handle, said first end of said tube being fluidly coupled to said conduit when said handle is coupled to said brush such that each of said second bristles is in fluid communication with said handle.

5. The assembly according to claim 4, further comprising a weight being positioned around said tube, said weight being aligned with said second end of said tube such that said weight retains said tube in said handle.

6. A fluid dispensing brush assembly being configured to selectively release a fluid while brushing hair, said assembly comprising:

a brush being configured to be manipulated thereby facilitating said brush to brush hair, said brush comprising:

a panel having a first surface and a first end, a plurality of first bristles, each of said first bristles being coupled to and extending away from said first surface wherein each of said first bristles is configured to brush the hair, said first bristles being spaced apart from each other and being distributed on said first surface, a plurality of second bristles, each of said second bristles being coupled to and extending away from said first surface, each of said second bristles having a distal end with respect to said first surface, each of said second bristles being hollow, said distal end corresponding to each of said second bristles being open, a plurality of boots, each of said boots having a primary end, a secondary end and an outer wall extending therebetween, said primary end being open, said outer wall having a plurality of openings, said primary end insertably receiving said distal end of an associated one of said second bristles, said outer wall having an undulated medial section such that said outer wall is flared to extend outwardly away from said distal end of said second bristle, then back inwardly to a straight end section of said outer wall adjacent and perpendicular to said secondary end of said boot, said openings being distributed along said undulated medial section wherein said openings have varied angling relative to said second bristle, a conduit extending between said first end of said panel and each of said second bristles;

a handle being removably coupled to said brush wherein said handle is configured to be gripped, said handle being substantially hollow wherein said handle is configured to contain a fluid, said handle being in fluid communication with said brush, said handle having a leading end and an outer surface, said outer surface being threaded adjacent to said leading end, said outer surface threadably engaging said first end of said panel;

a tube having a first end and a second end, said tube being positioned within said handle having said first end of said tube extending outwardly from said first end of said handle, said first end of said tube being fluidly coupled to said conduit when said handle is coupled to said brush such that each of said second bristles is in fluid communication with said handle;

a weight being positioned around said tube, said weight being aligned with said second end of said tube such that said weight retains said tube in said handle; and a pump being coupled to said brush wherein said pump is configured to be manipulated, said pump being in fluid communication with said handle wherein said pump is configured to selectively urge the fluid outwardly from said brush thereby facilitating the fluid to enhance brushing the hair, said pump being fluidly coupled to said conduit in said panel.

* * * * *